US011545775B2

(12) United States Patent
Liu et al.

(10) Patent No.: US 11,545,775 B2
(45) Date of Patent: Jan. 3, 2023

(54) CONNECTOR AND CONDUCTIVE TERMINAL MODULE

(71) Applicant: Tyco Electronics (Shanghai) Co. Ltd., Shanghai (CN)

(72) Inventors: Jiaoyong Liu, Shanghai (CN); Jie Luo, Foshan (CN); Guangming Zhao, Shanghai (CN)

(73) Assignee: Tyco Electronics (Shanghai) Co. Ltd., Shanghai (CN)

( * ) Notice: Subject to any disclaimer, the term of this patent is extended or adjusted under 35 U.S.C. 154(b) by 18 days.

(21) Appl. No.: 17/346,675

(22) Filed: Jun. 14, 2021

(65) Prior Publication Data

US 2021/0399454 A1 Dec. 23, 2021

(30) Foreign Application Priority Data

Jun. 19, 2020 (CN) ..... 202010563045.5

(51) Int. Cl.
*H01R 13/187* (2006.01)
*H01R 13/115* (2006.01)
*H01R 13/50* (2006.01)

(52) U.S. Cl.
CPC ..... *H01R 13/115* (2013.01); *H01R 13/187* (2013.01); *H01R 13/50* (2013.01)

(58) Field of Classification Search
CPC ..... H01R 13/115; H01R 13/11; H01R 13/10; H01R 13/187; H01R 13/18; H01R 13/50
USPC ..... 439/691
See application file for complete search history.

(56) References Cited

U.S. PATENT DOCUMENTS

| | | | | |
|---|---|---|---|---|
| 5,431,576 | A * | 7/1995 | Matthews | H01R 13/6315 439/247 |
| 5,588,884 | A * | 12/1996 | Rudoy | H01R 31/02 439/787 |
| 7,476,108 | B2 * | 1/2009 | Swain | H01R 12/7088 439/947 |
| 7,581,972 | B2 * | 9/2009 | Daamen | H01R 13/6315 439/249 |
| 8,057,266 | B1 * | 11/2011 | Roitberg | H01R 13/055 439/907 |
| 8,388,389 | B2 * | 3/2013 | Costello | H01R 13/26 439/637 |
| 9,070,990 | B2 * | 6/2015 | Flickinger | H01R 4/10 |
| 9,093,804 | B2 * | 7/2015 | Matocky | H01R 31/02 |
| 9,190,791 | B1 * | 11/2015 | Jaena | H01R 13/187 |
| 9,680,236 | B2 * | 6/2017 | Ngo | H01R 4/48 |
| 10,050,395 | B2 * | 8/2018 | Ngo | H01R 4/023 |
| 10,651,578 | B2 * | 5/2020 | Li | H01R 25/14 |
| 10,879,647 | B2 * | 12/2020 | Brungard | H01R 13/631 |
| 2009/0047814 | A1 * | 2/2009 | Daamen | H01R 13/18 439/251 |

(Continued)

*Primary Examiner* — Harshad C Patel
(74) *Attorney, Agent, or Firm* — Barley Snyder

(57) ABSTRACT

A connector for electrically connecting to a conductor comprises a pair of conductive terminals, each including a U-shaped fixing portion and an elastic contact arm extending from the U-shaped fixing portion. The connector further includes a pair of pressing members, each having a U-shaped holding portion and an elastic support arm extending from the U-shaped holding portion. Each of the pressing members is fit within the U-shaped fixing portion of the respective conductive terminal by the U-shaped holding portion, and at least a portion of the elastic support arm is abutted against the elastic contact arm.

20 Claims, 5 Drawing Sheets

(56) References Cited

U.S. PATENT DOCUMENTS

| | | | | |
|---|---|---|---|---|
| 2014/0158395 | A1* | 6/2014 | Billman | H01R 31/085<br>174/68.2 |
| 2019/0089093 | A1* | 3/2019 | Liu | H01R 4/46 |

* cited by examiner

CONNECTOR AND CONDUCTIVE TERMINAL MODULE

CROSS-REFERENCE TO RELATED APPLICATIONS

This application claims priority under 35 U.S.C. § 119 to Chinese Patent Application No. 202010563045.5, filed Jun. 19, 2020, the entire disclosure of which is incorporated herein by reference.

FIELD OF THE INVENTION

The present disclosure relates to an electrical connector and to a conductive terminal module.

BACKGROUND

In the related art, a power connector generally includes a pair of conductive terminals and an insulation partition member. The insulation partition member includes a partition body portion disposed between the pair of conductive terminals and a pair of elastic arms clamped on outer sides of the pair of conductive terminals, respectively. In addition, in the related art, an elastic clip is often disposed outside the insulation partition member. The elastic clip has a pair of elastic clamping arms clamped on the pair of elastic arms of the insulation partition member. However, the insulation partition member and the elastic clip both surround the conductive terminals, which increases the overall size of the power connector, particularly in a width direction. This increase in general size and/or width cannot meet the size requirements in many current miniaturized applications.

SUMMARY

According to an embodiment of the present disclosure, a connector for electrically connecting to a conductor comprises a pair of conductive terminals, each including a substantially U-shaped fixing portion and an elastic contact arm extending from the U-shaped fixing portion. The connector further includes a pair of pressing members, each having a substantially U-shaped holding portion and an elastic support arm extending from the U-shaped holding portion. Each of the pressing members is fit within the U-shaped fixing portion of the respective conductive terminal by the U-shaped holding portion, with at least a portion of the elastic support arm abutted against the elastic contact arm.

BRIEF DESCRIPTION OF THE DRAWINGS

The invention will now be described by way of example with reference to the accompanying Figures, of which.

DETAILED DESCRIPTION OF THE EMBODIMENTS

Figure 1:
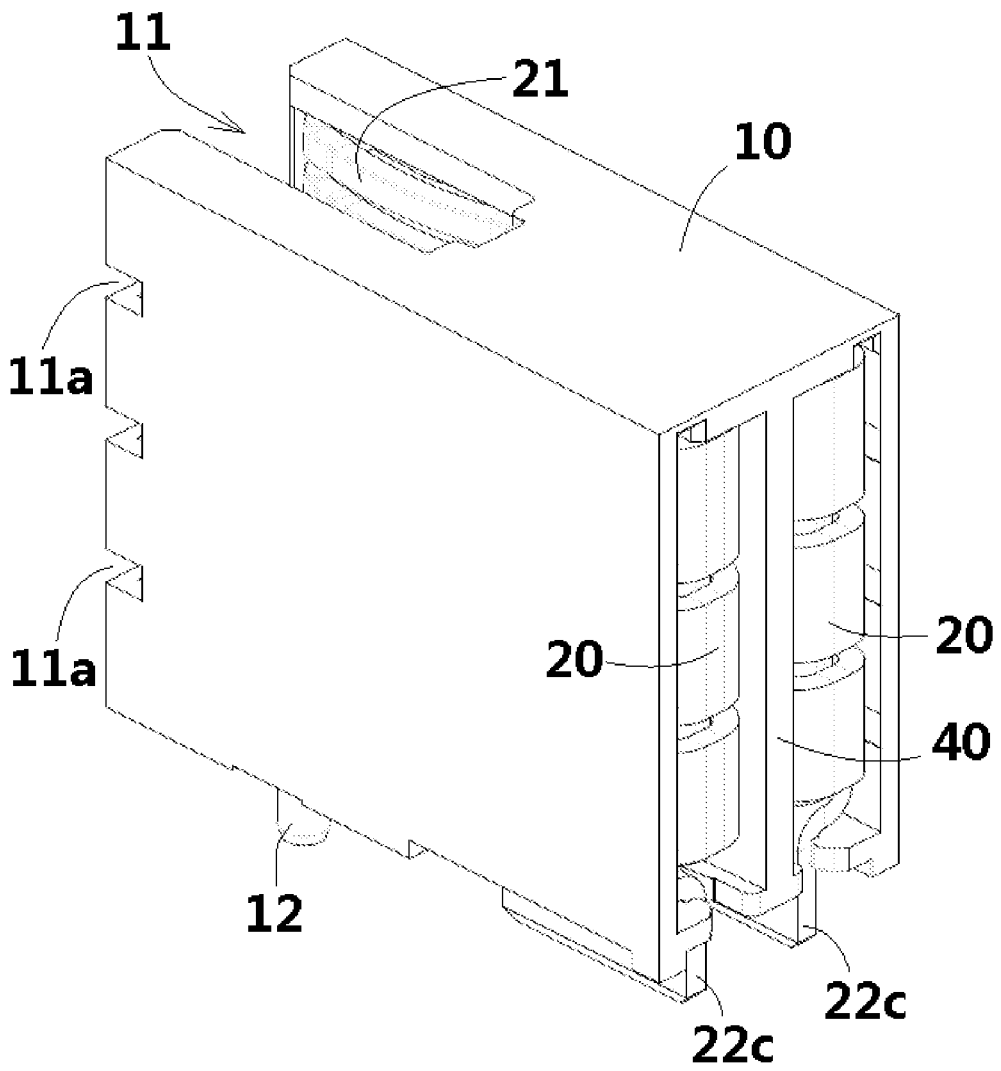
FIG. 1 shows a schematic perspective view of a connector according to an exemplary embodiment of the present disclosure.

Exemplary embodiments of the present disclosure will be described hereinafter in detail with reference to the attached drawings, wherein the like reference numerals refer to the like elements. The present disclosure may, however, be embodied in many different forms and should not be construed as being limited to the embodiment set forth herein; rather, these embodiments are provided so that the present disclosure will be thorough and complete, and will fully convey the concept of the disclosure to those skilled in the art.

In the following detailed description, for purposes of explanation, numerous specific details are set forth in order to provide a thorough understanding of the disclosed embodiments. It will be apparent, however, that one or more embodiments may be practiced without these specific details. In other instances, well-known structures and devices are schematically shown in order to simplify the drawing.

According to an embodiment of the present disclosure, a connector comprises an insulation housing formed with a plurality of terminal slots, and a plurality of terminals inserted into the plurality of terminal slots, respectively. Each of the plurality of terminals has a pin protruding from the bottom of the insulation housing for insertion into a terminal hole in a circuit board. At least one latch is formed on the insulation housing for being inserted and locked into a latch hole in the circuit board.

According to another embodiment or concept of the present disclosure, a connector adapted to be electrically connected to a conductor includes a pair of conductive terminals, each of which includes a substantially U-shaped fixing portion and an elastic contact arm extending from the U-shaped fixing portion. The connector further includes a pair of pressing members, each of which has a substantially U-shaped holding portion and an elastic support arm extending from the U-shaped holding portion. Each of the pressing members is fit within the U-shaped fixing portion of the conductive terminal by the U-shaped holding portion, and at least a portion of the elastic support arm is abutted against the elastic contact arm.

According to another concept or embodiment of the present disclosure, a conductive terminal module includes a conductive terminal having a substantially U-shaped bent fixing portion and an elastic contact arm extending from the fixing portion. The terminal module further includes a pressing member having a substantially U-shaped bent holding portion and a support arm extending from the holding portion. The pressing member is fit within the U-shaped bent fixing portion of the conductive terminal by the holding portion, and at least a portion of the support arm is abutted against the elastic contact arm.

Figure 2:
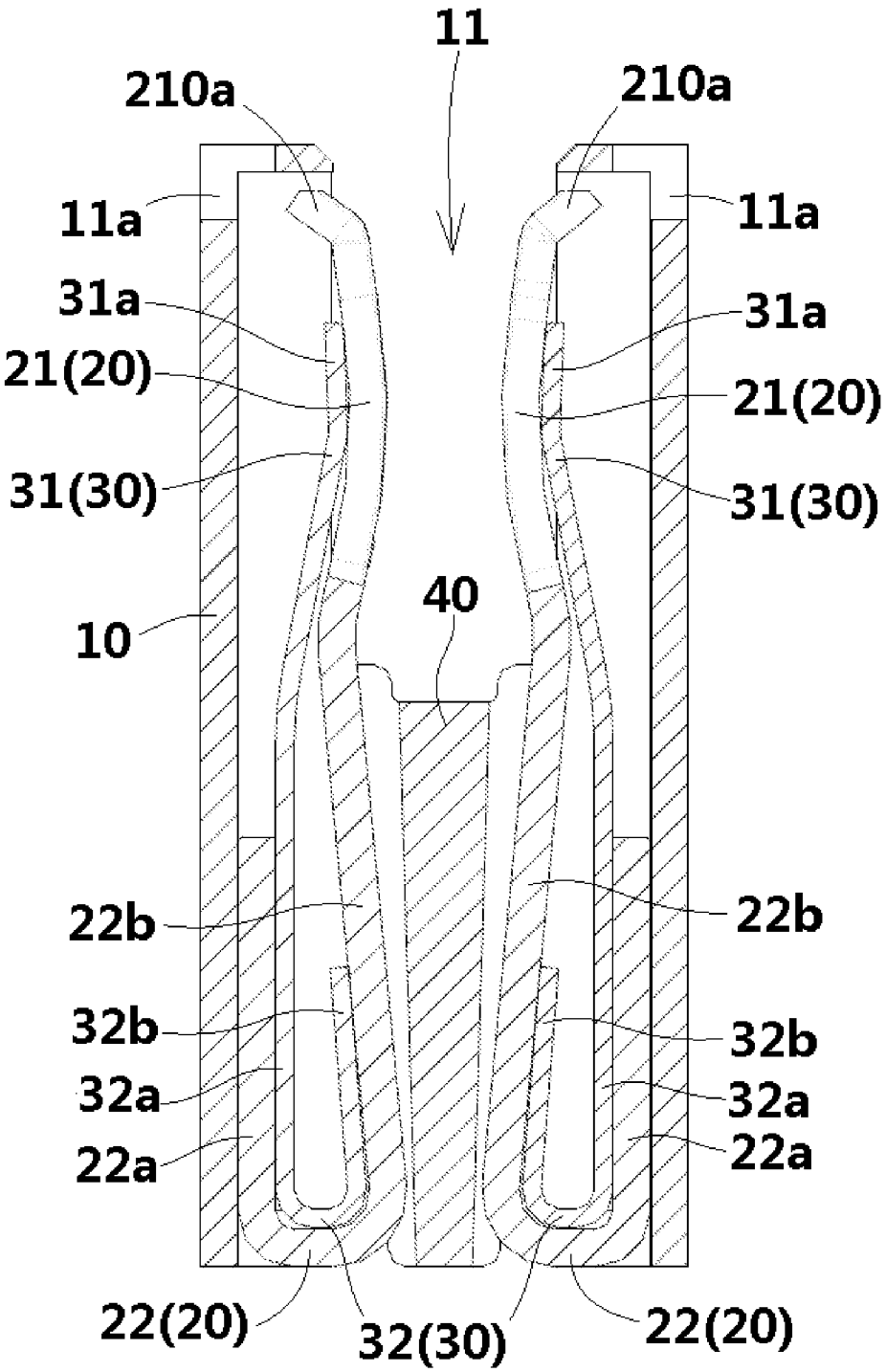
FIG. 2 shows a cross-sectional view of a connector according to an exemplary embodiment of the present disclosure.
Figure 3:
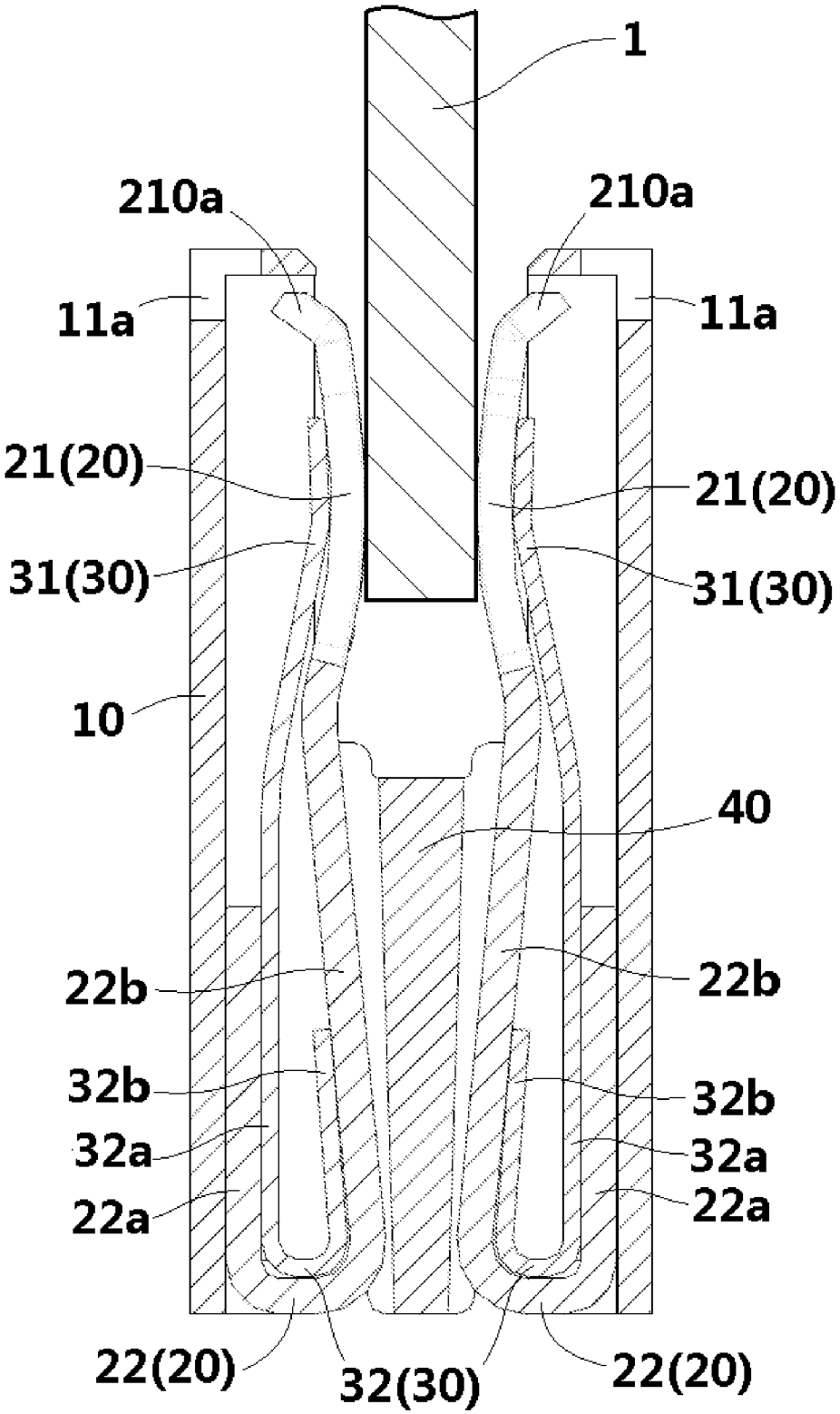
FIG. 3 shows a schematic view of a conductive terminal, a pressing member and an insulation partition member of a connector according to an exemplary embodiment of the present disclosure.

FIG. 1 shows a schematic perspective view of a connector according to an exemplary embodiment of the present disclosure. FIG. 2 shows a cross-sectional view of a connector according to an exemplary embodiment of the present disclosure. FIG. 3 shows a schematic view of a conductive terminal 20, a pressing member 30 and an insulation partition member 40 of a connector according to an exemplary embodiment of the present disclosure.

As shown in FIGS. 1-3, in the illustrated embodiment, the connector is adapted to be electrically connected to a conductor 1. The connector includes a pair of conductive terminals 20 and a pair of pressing members 30. Each of the conductive terminals 20 includes a substantially U-shaped fixing portion 22 and an elastic contact arm 21 extending from the U-shaped fixing portion 22. Each of the pressing members 30 includes a substantially U-shaped holding portion 32 and an elastic support arm 31 extending from the U-shaped holding portion 32. Each of the pressing members 30 is fit within the U-shaped fixing portion 22 of the respective conductive terminal 20 by the U-shaped holding portion 32, and at least a portion of the elastic support arm 31 is abutted against the elastic contact arm 21.

As shown in FIGS. 1-3, in the illustrated embodiment, each of the pressing members 30 is fit within an internal space enclosed by the respective conductive terminal 20 such that each of the conductive terminals 20 surrounds the respective pressing member 30. In this way, a space outside the conductive terminals 20 is not occupied by the pressing members 30. Thus, the connector can be reduced in size. As shown in FIGS. 1-3, in the illustrated embodiment, the at least portion of the elastic support arm 31 of the pressing member 30 is abutted against the elastic contact arm 21 to support the conductive terminal 20. In this way, an elastic contact force between the conductive terminals 20 and the conductor 1 is improved, and the conductive terminal 20 is prevented from yielding.

As shown in FIGS. 1-3, in the illustrated embodiment, the connector further includes an insulation partition member 40 disposed between the pair of conductive terminals 20 to separate the pair of conductive terminals 20 from each other.

As shown in FIGS. 1-3, in the illustrated embodiment, the connector further includes an insulation housing 10 into which the conductive terminals 20, the pressing members 30 and the insulation partition member 40 are mounted.

Figure 4:
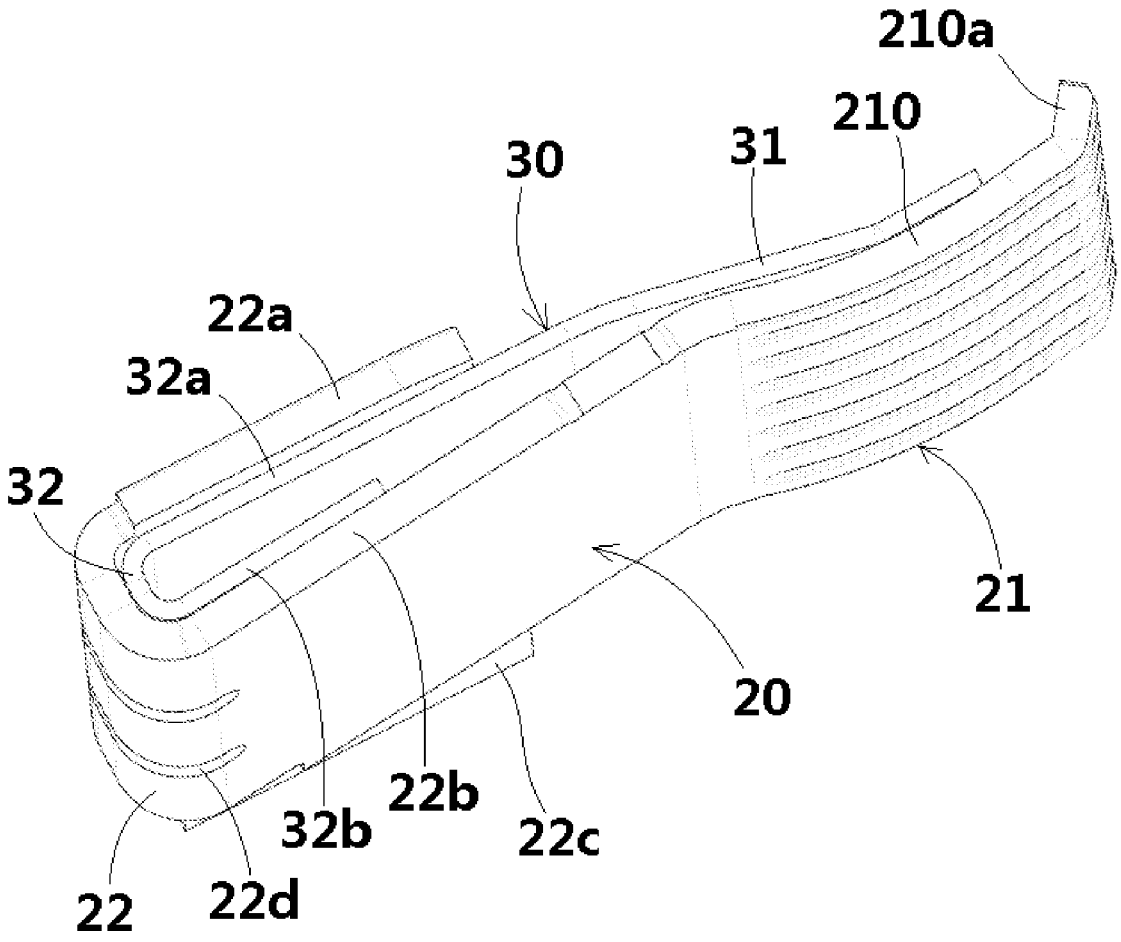
FIG. 4 shows a schematic perspective view of one conductive terminal and one pressing member of the connector according to an exemplary embodiment of the present disclosure when viewed from one side.
Figure 5:
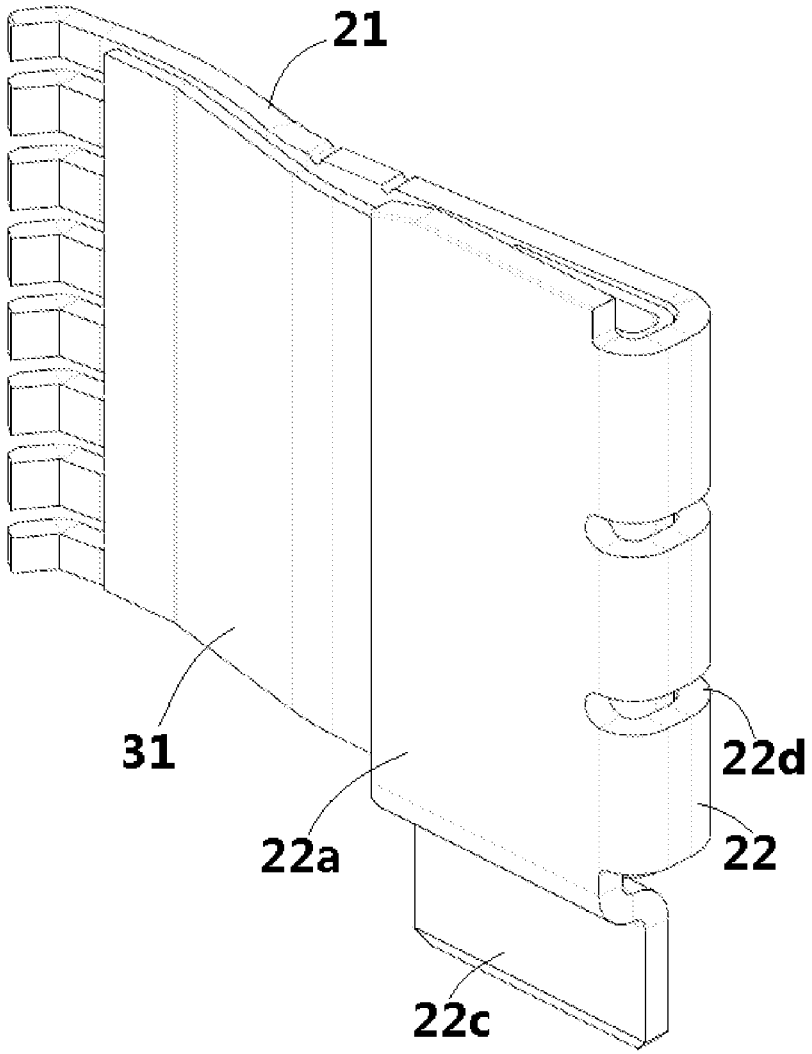
FIG. 5 shows a schematic perspective view of one conductive terminal and one pressing member of the connector according to an exemplary embodiment of the present disclosure when viewed from the other side.

FIG. 4 shows a schematic perspective view of one conductive terminal 20 and one pressing member 30 of the connector according to an exemplary embodiment of the present disclosure when viewed from one side. FIG. 5 shows a schematic perspective view of the conductive terminal 20 and the pressing member 30 of the connector according to an exemplary embodiment of the present disclosure when viewed from the other side.

As shown in FIGS. 1-5, in the illustrated embodiment, the U-shaped fixing portion 22 of each conductive terminal 20 is fixed between the insulation housing 10 and the insulation partition member 40.

As shown in FIGS. 1-5, in the illustrated embodiment, the U-shaped fixing portion 22 of the conductive terminal 20 is fixed between the insulation housing 10 and the insulating partition member 40 by means of its own elastic deformation force.

As shown in FIGS. 1-5, in the illustrated embodiment, the U-shaped holding portion 32 of each pressing member 30 is fit and fixed within the U-shaped fixing portion 22 of the respective conductive terminal 20.

As shown in FIGS. 1-5, in the illustrated embodiment, the U-shaped holding portion 32 of each pressing member 30 is fixed within the U-shaped fixing portion 22 of the respective conductive terminal 20 by means of its own elastic deformation force.

As shown in FIGS. 1-5, in the illustrated embodiment, the U-shaped fixing portion 22 of each conductive terminal 20 includes a first plate-shaped wall 22*a* abutted against an inner wall of the insulation housing 10 and a second plate-shaped wall 22*b* abutted against the insulation partition member 40.

As shown in FIGS. 1-5, in the illustrated embodiment, the U-shaped holding portion 32 of each pressing member 30 includes a first plate-shaped side wall 32*a* and a second plate-shaped side wall 32*b* that are abutted against inner sides of the first wall 22*a* and the second wall 22*b* of the respective conductive terminal 20, respectively.

As shown in FIGS. 1-5, in the illustrated embodiment, the elastic contact arm 21 of each conductive terminal 20 is connected to the second wall 22*b* of the U-shaped fixing portion 22 and extends forwardly from the second wall 22*b* of the U-shaped fixing portion 22. The elastic support arm 31 of each pressing member 30 is connected to the first wall 22*a* of the U-shaped holding portion 32 and extends forwardly from the first wall 22*a* of the U-shaped holding portion 32.

As shown in FIGS. 1-5, in the illustrated embodiment, the elastic support arm 31 includes an end portion 31*a* at a free end thereof. The end portion 31*a* of the elastic support arm 31 is in contact with the elastic contact arm 21.

As shown in FIGS. 1-5, in the illustrated embodiment, the elastic support arm 31 has a length less than that of the elastic contact arm 21, and the elastic contact arm 21 extends beyond the end portion 31*a* of the elastic support arm 31.

As shown in FIGS. 1-5, in the illustrated embodiment, the elastic contact arm 21 is made of a first material, and the elastic support arm 31 is made of a second material different from the first material. The first material has better conductive performance (e.g., greater conductivity) than that of the second material, and the second material has a higher mechanical strength than that of the first material. For example, the elastic contact arm 21 may be made of copper or copper alloy, and the elastic support arm 31 made of stainless steel.

As shown in FIGS. 1-5, in the illustrated embodiment, the insulation housing 10 has a first side and a second side opposite to each other in a longitudinal direction thereof. Further, the first side of the insulation housing 10 is formed with an insertion slot 11. The elastic contact arms 21 of the pair of conductive terminals 20 are received in the insertion slot 11 and adapted to be electrically connected with the conductor 1 that is inserted into the insertion slot 11.

As shown in FIGS. 1-5, in the illustrated embodiment, the insulation partition member 40 has a cross-section of an isosceles trapezoid in a longitudinal direction thereof. The isosceles trapezoid has a first bottom side close to the second side of the insulation housing 10 and a second bottom side away from the second side of the insulation housing 10. The second bottom side has a length greater than that of the first bottom side.

As shown in FIGS. 1-5, in the illustrated embodiment, the elastic contact arm 21 includes a row of comb-shaped elastic arms 210. An end portion 210*a* of each elastic arm 210 is bent outwardly. A limiting hole 11*a* corresponding to the end portion 210*a* of the respective elastic arm 210 is formed in a side wall at each side of the insertion slot 11 of the housing 10, and the end portion 210*a* of the elastic arm 210 is configured to be inserted into the limiting hole 11*a*.

As shown in FIGS. 1-5, in the illustrated embodiment, each conductive terminal 20 further has a welding portion 22*c* connected to a lower side of the U-shaped fixing portion 22. The welding portion 22*c* is exposed from a bottom portion of the insulation housing 10 so as to be welded onto a circuit board (not shown).

As shown in FIGS. 1-5, in the illustrated embodiment, a plurality of arc-shaped grooves 22*d* are formed in an arc-shaped bottom wall of the U-shaped fixing portion 22 of each conductive terminal 20. In this way, bending strength of the U-shaped fixing portion 22 can be reduced, which facilitates bending and molding.

As shown in FIGS. 1-5, in the illustrated embodiment, the insulation housing 10 has a columnar protrusion 12 protruding from a bottom portion thereof, and the columnar protrusion 12 is adapted to be inserted into a positioning hole in the circuit board.

As shown in FIGS. 1-5, in the illustrated embodiment, the present disclosure also discloses a conductive terminal module. The conductive terminal module includes a conductive terminal 20 and a pressing member 30. The conductive terminal 20 includes a substantially U-shaped bent fixing portion 22 and an elastic contact arm 21 extending from the fixing portion 22. The pressing member 30 includes a substantially U-shaped bent holding portion 32 and a support arm 31 extending from the holding portion 32. The pressing member 30 is fit within the U-shaped bent fixing portion 22 of the conductive terminal 20 by the holding portion 32, and at least a portion of the support arm 31 is abutted against the elastic contact arm 21.

As shown in FIGS. 1 to 5, in the illustrated embodiment, the fixing portion 22 includes a first wall 22*a* and a second wall 22*b*, and the elastic contact arm 21 extends from the second wall 22*b*.

As shown in FIGS. 1-5, in the illustrated embodiment, the holding portion 32 of the pressing member 30 includes a first side wall 32*a* and a second side wall 32*b*. Further, the first side wall 32*a* is abutted against the first wall 22*a* of the conductive terminal 20, and the second side wall 32*b* is abutted against the second wall 22*b* of the conductive terminal 20. In addition, the support arm 31 extends from the first side wall 32*a*.

It should be appreciated for those skilled in this art that the above embodiments are intended to be illustrated, and not restrictive. For example, many modifications may be made to the above embodiments by those skilled in this art, and various features described in different embodiments may be freely combined with each other without conflicting in configuration or principle.

Although several exemplary embodiments have been shown and described, it would be appreciated by those skilled in the art that various changes or modifications may be made in these embodiments without departing from the principles and spirit of the disclosure, the scope of which is defined in the claims and their equivalents.

As used herein, an element recited in the singular and proceeded with the word "a" or "an" should be understood as not excluding plural of said elements or steps, unless such exclusion is explicitly stated. Furthermore, references to "one embodiment" of the present disclosure are not intended to be interpreted as excluding the existence of additional embodiments that also incorporate the recited features. Moreover, unless explicitly stated to the contrary, embodiments "comprising" or "having" an element or a plurality of elements having a particular property may include additional such elements not having that property.

What is claimed is:

1. A connector for electrically connecting to a conductor, comprising:

a pair of conductive terminals, each including a U-shaped fixing portion and an elastic contact arm extending from the U-shaped fixing portion; and a pair of pressing members, each including a U-shaped holding portion and an elastic support arm extending from the U-shaped holding portion, each of the pressing members is fit within the U-shaped fixing portion of the respective conductive terminal by the U-shaped holding portion, and at least a portion of the elastic support arm is abutted against the elastic contact arm.

2. The connector according to claim 1, further comprising an insulation partition member disposed between and separating the pair of conductive terminals.

3. The connector according to claim 1, wherein a free end portion of the elastic support arm contacts the elastic contact arm, the elastic support arm having a length less than that of the elastic contact arm, and the elastic contact arm extending beyond the end portion of the elastic support arm.

4. The connector according to claim 1, wherein the elastic contact arm is made of a first material and the elastic support arm is made of a second material different from the first material, the first material having greater electrical conductivity than that of the second material, and the second material having greater mechanical strength than that of the first material.

5. The connector according to claim 2, further comprising an insulation housing into which the conductive terminals, the pressing members and the insulation partition member are mounted.

6. The connector according to claim 5, wherein the insulation housing includes a columnar protrusion protruding from a bottom portion thereof to be inserted into a positioning hole in a circuit board.

7. The connector according to claim 5, wherein the U-shaped fixing portion of each conductive terminal is fixed between the insulation housing and the insulation partition member.

8. The connector according to claim 5, wherein the insulation housing has a first side and a second side opposite each other in a longitudinal direction thereof, the first side of the insulation housing is formed with an insertion slot, and the elastic contact arms of the pair of conductive terminals are received in the insertion slot for electrically connecting with the conductor inserted therein.

9. The connector according to claim 8, wherein the insulation partition member has a cross-section of an isosceles trapezoid in a longitudinal direction thereof, the isosceles trapezoid having a first bottom side close to the second side of the insulation housing and a second bottom side away from the second side of the insulation housing, the second bottom side having a length greater than that of the first bottom side.

10. The connector according to claim 8, wherein the elastic contact arm includes a row of comb-shaped elastic arms with an end portion of each elastic arm bent outwardly, a limiting hole corresponding to the end portion of the elastic arm is formed in a side wall at each side of the insertion slot of the housing with the end portion of the elastic arm inserted therein.

11. The connector according to claim 7, wherein
the U-shaped fixing portion of the conductive terminal is fixed between the insulation housing and the insulation partition member by means of its own elastic deformation force.

12. The connector according to claim 11, wherein
the U-shaped holding portion of the pressing member is fit and fixed within the U-shaped fixing portion of the respective conductive terminal by means of its own elastic deformation force.

13. The connector according to claim 7, wherein
the U-shaped holding portion of each pressing member is fit and
fixed within the U-shaped fixing portion of the respective conductive terminal.

14. The connector according to claim 13, wherein
the U-shaped fixing portion of the conductive terminal includes
a first plate-shaped wall abutted against an inner wall of the insulation housing and
a second plate-shaped wall abutted against the insulation partition member.

15. The connector according to claim 14, wherein
the U-shaped holding portion of the pressing member includes
a first plate-shaped side wall and
a second plate-shaped side wall abutted against inner sides of the first wall and the second wall of the conductive terminal, respectively.

16. The connector according to claim 15, wherein
the elastic contact arm of the conductive terminal is connected to the second wall of the U-shaped fixing portion and extends forwardly from the second wall of the U-shaped fixing portion,
the elastic support arm of the pressing member is connected to the first wall of the U-shaped holding portion and extends forwardly from the first wall of the U-shaped holding portion.

17. The connector according to claim 7, wherein
each conductive terminal further includes
a welding portion connected to a lower side of the U-shaped fixing portion,
the welding portion being exposed from a bottom portion of the insulation housing so as to be welded onto a circuit board,
a plurality of arc-shaped grooves are formed in an arc-shaped bottom wall of the U-shaped fixing portion of each conductive terminal.

18. A conductive terminal module, comprising:
a conductive terminal comprising
a substantially U-shaped bent fixing portion and
an elastic contact arm extending from the fixing portion; and
a pressing member comprising
a substantially U-shaped bent holding portion and
a support arm extending from the holding portion,
the pressing member is fit within the U-shaped bent fixing portion of the conductive terminal by the holding portion, and
at least a portion of the support arm is abutted against the elastic contact arm.

19. The conductive terminal module according to claim 18, wherein
the fixing portion includes a first wall and a second wall,
the elastic contact arm extending from the second wall.

20. The conductive terminal module according to claim 19, wherein
the holding portion of the pressing member includes
a first side wall and a second side wall,
the first side wall abutted against the first wall of the conductive terminal, and
the second side wall abutted against the second wall of the conductive terminal,
the support arm extending from the first side wall.

* * * * *